United States Patent [19]

Johns

[11] 3,954,300

[45] May 4, 1976

[54] MINING MACHINE LONGWALL PROPULSION MEANS

[75] Inventor: Robert W. Johns, Calgary, Canada

[73] Assignee: World Oil Mining Ltd., Calgary, Canada

[22] Filed: Feb. 13, 1975

[21] Appl. No.: 549,823

[52] U.S. Cl. ..... 299/42; 299/33

[51] Int. Cl.[2] ..... E21C 29/02

[58] Field of Search ..... 299/32–34, 299/42–54; 105/29

[56] References Cited

UNITED STATES PATENTS

| | | | |
|---|---|---|---|
| 569,097 | 10/1896 | Fryer | 105/29 R |
| 2,539,962 | 1/1951 | Mavor | 299/32 |

FOREIGN PATENTS OR APPLICATIONS

| | | | |
|---|---|---|---|
| 1,292,076 | 10/1972 | United Kingdom | 299/43 |
| 12,029 | 5/1890 | United Kingdom | 105/29 R |

*Primary Examiner*—Ernest R. Purser
*Attorney, Agent, or Firm*—McLaws & Company

[57] ABSTRACT

A propulsion motor is disclosed for use in propelling the mining machine used in a fixed arch shield mining system wherein the mining machine is movably supported by the shield. The propulsion motor comprises a power transfer means secured to the mining machine and being shiftable from a non-cutting position to a cutting position. The power transfer means includes a drive arrangement having portions engageable with certain of the arches of the mining shield for propelling the mining machine.

12 Claims, 11 Drawing Figures

MINING MACHINE LONGWALL PROPULSION MEANS

CROSS-REFERENCE TO RELATED APPLICATION

This invention is related to co-pending application Ser. No. 509,489 filed Sept. 26, 1974 and entitled Apparatus And Method For Mining Tar Sands, Oil Shales and Other Minerals, which application is incorporated by reference herein.

This invention relates to a propulsion motor for use in advancing the mining machine used in fixed arch shield mining technology.

BACKGROUND AND OBJECTS

The fixed-arch shield method of mining is particularly useful for the underground mining of bituminous sands, oil shales, and other friable mineral deposits. The technique is a refinement of the "Longwall" method of underground mining which is widely used in mining coal, phosphate, trona and other minerals.

The cutting machines used in all of these techniques are most often shearers, trepaners or ploughs, or combinations of these.

In the fixed-arch shield technique, as disclosed in the aforementioned co-pending application, a network of longitudinal operating tunnels are arranged and connected by transverse mining shields. The shields are formed from a plurality of adjacent half-arches which collectively form the shield. Rails are provided along the base of the shield and supported by the bases of the arches, and the mining equipment is moved along these rails. For a further description of this type of mining technique, reference is had to the aforementioned co-pending application.

The power supply used in this mining system is used in several ways. It is used to power the cutting drum in the case of shearers and trepaners, to plough the broken material into the face of the conveyor for removing the material from the mining area, to advance the plough if the plough is used as the primary excavator, and to advance the mining machinery along the working face. The present invention deals with the apparatus whereby the mining machinery is advanced along the shield as the mining process progresses.

Heretofore, the machinery was almost universally advanced by means of a chain and sprocket arrangement whereby the machine is equipped with drive sprockets which engage the links of a chain and pull the machinery ahead along the chain. With the chain being stretched the full length of the mining face and anchored at each end, the machinery may advance this entire length.

By its very nature, however, the prior art chain drive arrangement has certain limitations. Most significantly, the chain may stretch or may even break, thus requiring considerable down time for the apparatus. Of course the stretching of the chain also causes difficulties in that the chain must be constantly tightened or, unequal stretching of the links results in the chain not properly fitting the drive sprockets or causing excessive wear.

Periodically, efforts have been made to overcome the limitations of the chains drive by providing a more positive drive means along the mining face. Various forms of rack and pinion drive means have been somewhat successful in this regard. In such a construction, frequently the mined material conveyor is interconnected with the machinery in a manner to advance the mining machine.

By virtue of the development of the fixed-arch shield technique and the close integration of the mining machinery with the shield, the fixed arches are designed so that a continuous "rack" is provided by the shield along the full length of the mining face. Below the inner curved face of the fixed arch, there is a portion of the arch structure where the web of the arch along with the reinforcing side plates is exposed in a vertical section. With the arches lined up side-by-side to form the shield, these exposed portions of the web and the side plates collectively form a series of strong, evenly-spaced cleats in the nature of a "rack" upon which a suitable "pinion" drive can operate.

By this structure, considerably more power may be transmitted to the drive than could be absorbed by the conventional chain drive.

Accordingly, a primary object of this invention is to provide a drive mechanism for mining machinery used in the fixed-arch shield mining technique.

Still another object of this invention is a propulsion system for mining machinery which overcomes the disadvantages of prior art propulsion means.

A further object of this invention is to provide a drive mechanism for mining machinery for use in the fixed-arch shield technique wherein at least portions of the arches serve as the rack in a "rack and pinion" drive.

Still a further object of this invention is to provide a propulsion motor which is movable between a cutting position and a non-cutting position of the mining machinery.

DESCRIPTION OF THE DRAWINGS

These and other objects and advantages of this invention will become apparent when considered in light of the following description and claims when taken together with the accompanying drawings in which:

DESCRIPTION OF THE INVENTION

Figure 1:
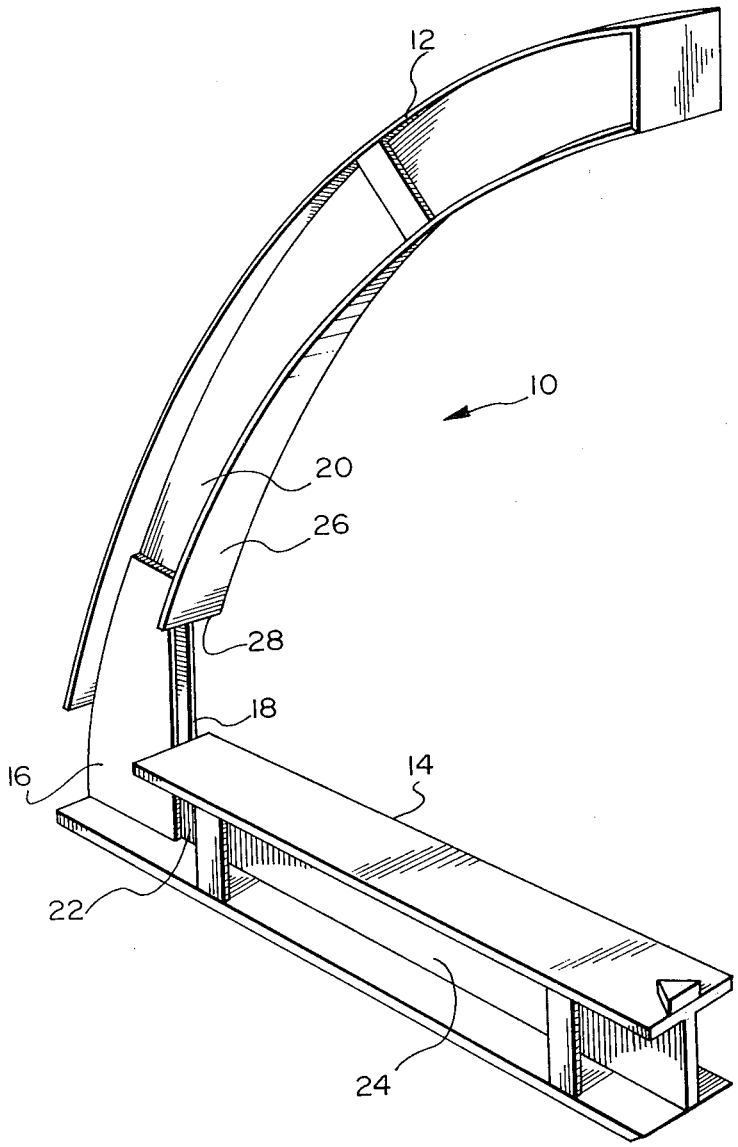
FIG. 1 is a perspective view of a fixed arch which cooperates with the propulsion motor of this invention.

Referring to FIG. 1, one of the arches generally designated 10 is illustrated. The arch 10 is seen to include a vertically, upstanding arcuate portion 12 and a horizontal base portion 14. It has been found that more maximum strength-to-weight ratio, the arcuate section 12 and the base section 14 should be of an H cross-section with uniform and equal flange widths. A pair of gusset plates 16 and 18 are secured by bolting or welding to the web 20 of the arch portion 12 and similarly by bolting or welding to an extension 22 of the web 24 of the base section 14.

The inside flange 26 of the arcuate section 12 is cut away adjacent the base section 14 as indicated at 28 thereby revealing the gusset plates 16 and 18, and making these plates accessible to the interior of the shield.

For a further description of the arch sections 10, reference is had to the aforementioned co-pending application Ser. No. 509,489.

Figure 2:
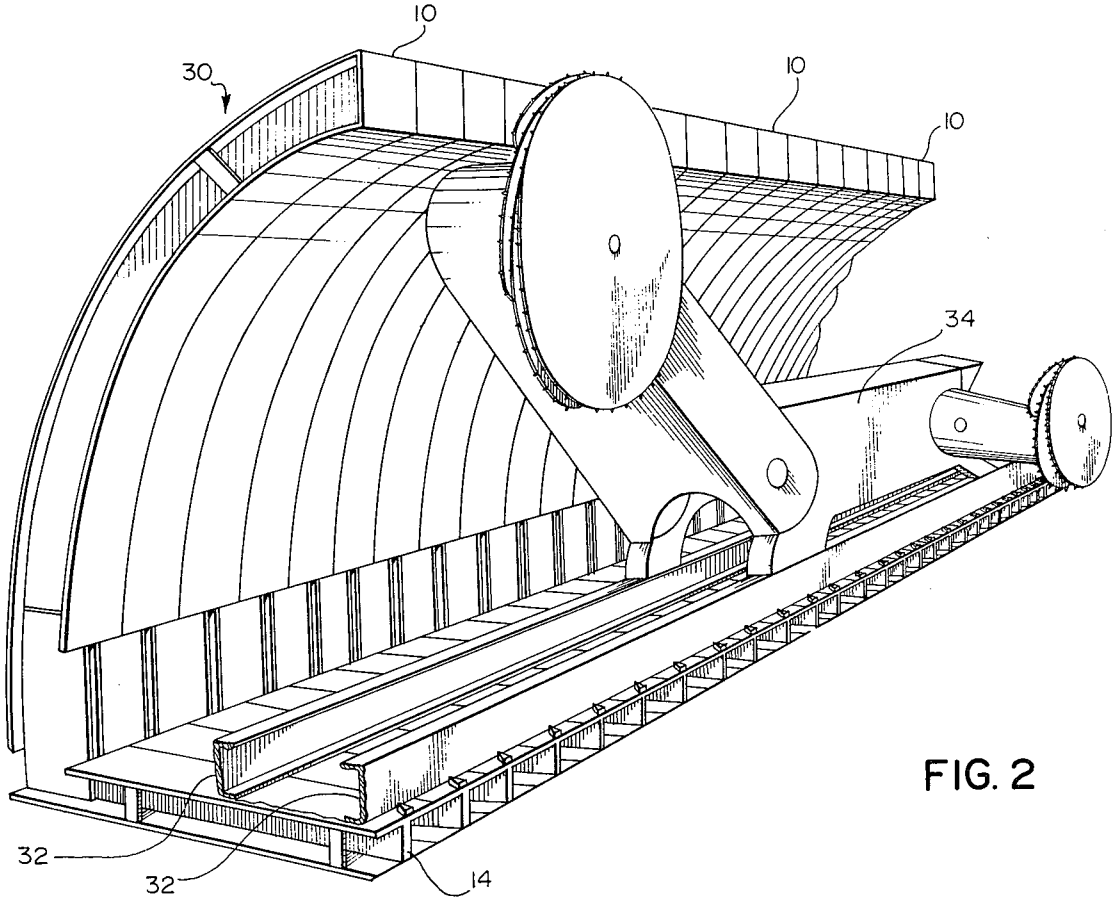
FIG. 2 is a perspective view of a portion of a fixed arch shield showing the mining machine in place thereon.

Referring to FIG. 2, it can be seen that a mining shield 30 is formed by a plurality of arches 20 when placed in adjacent side-by-side relationship. Mounted on the base sections 14 of the arches 10 are a pair of rails 32. The rails 32 are used for supporting the mining machine 34 in a manner so that the machine 34 may travel along the rails as is apparent from the drawings.

Figure 3:
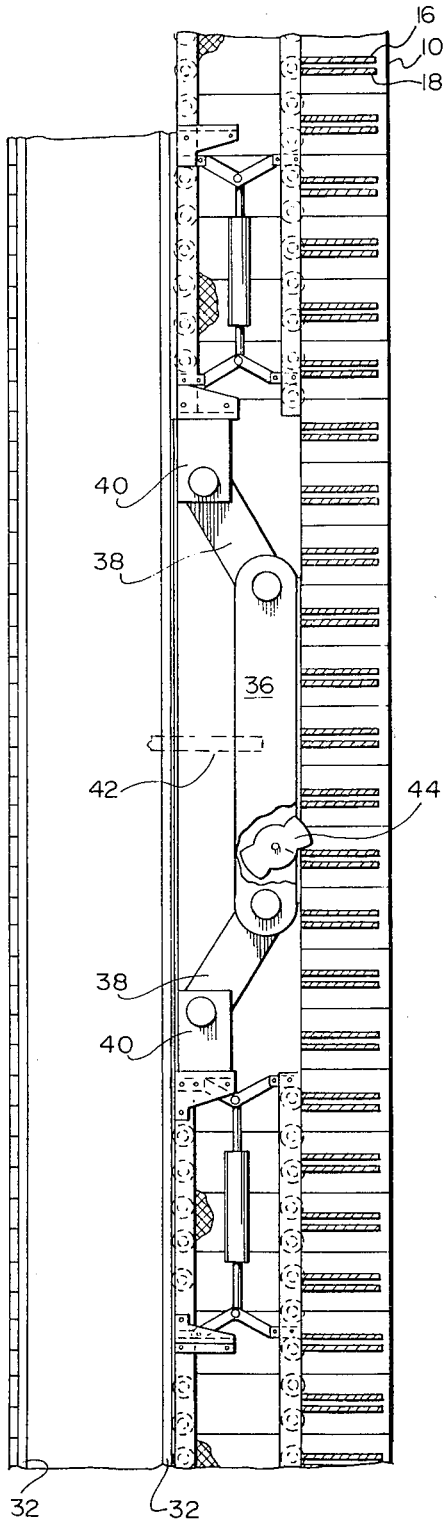
FIG. 3 is a sectional view with portions broken away for clarity of the relationship of the propulsion motor and the fixed arches.

Referring now to FIG. 3, the arch sections 10 and the gusset plates 16 and 18 are shown as are the rails 32, but with the mining machine removed for purposes of clarity.

A power transfer unit 36 is seen to be connected by links 38 to bosses 40 in a manner to be described more fully hereinafter. The bosses 40 are connected to the mining machine 34 through any suitable arrangement. A power take-off connection 42 is shown in a schematic nature, since the exact nature of the power take-off connection 42 will depend upon the type of power take-off unit used on the mining machine.

A plurality of drive gears 44 are provided within the power transfer unit 36 in such a manner that they are engageable with the gusset plates 16 and 18. By this construction, when the drive gears 44 are rotated into contact with the stationary gusset plates 16 and 18, the mining machinery is advanced as will be apparent.

Figure 5:
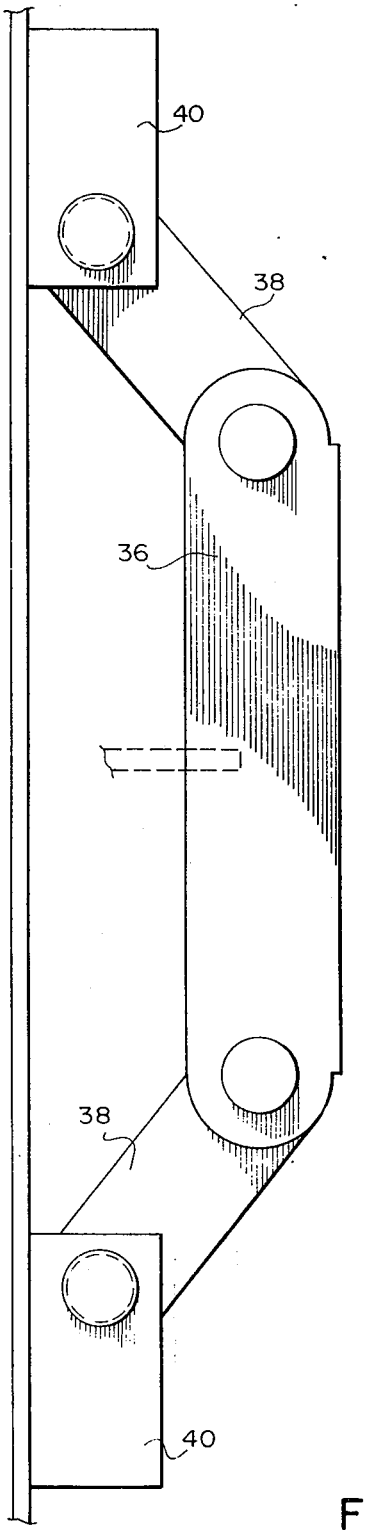
FIG. 5 is a plan view similar to FIG. 4 showing the propulsion motor in the cutting position.
Figure 4:
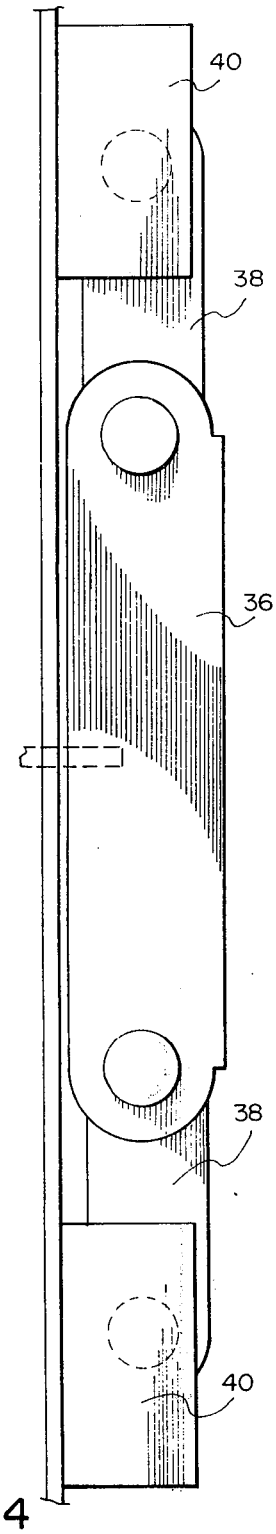
FIG. 4 is a plan view of the propulsion motor of this invention when in the non-cutting position, or disengaged for maintenance or repairs.

FIG. 4 illustrated on an enlarged scale the power transfer unit 36. In FIG. 4 the power transfer unit is shown in the retracted or non-cutting position (wherein the mining machine is retracted into the shield and is not cutting the working face). FIG. 5 illustrates the same portions but with the power transfer unit 36 in the cutting position whereby the drive gears 44 would be engageable with the arches. The retractor of the drive motor is synchronized with the position of the cutting equipment and retraction can only be arranged when the cutters are in an intermediate or neutral position and the "kickover" inoperative.

Figure 6:
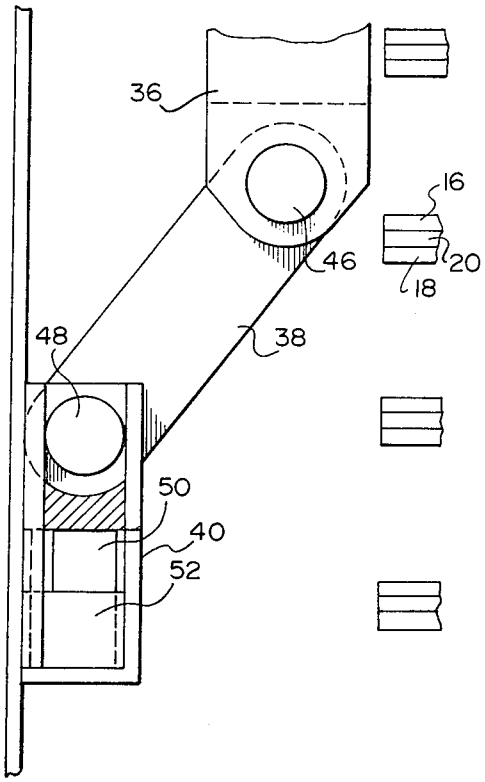
FIG. 6 is a plan view partly in section of the portion of the propulsion motor used for shifting the propulsion motor between the cutting and non-cutting positions.

FIG. 6 illustrates the means by which the shifting of the power transfer unit 36 is accomplished. Here it is noted that the power transfer unit 36 is pivotally connected to the links 38 by means of suitable pivot members 46. Similarly, the links 38 are connected by means of pivot members 48 to a hydraulic piston 50 mounted in cylinder 52. Although the piston and cylinder arrangement is shown somewhat schematically, it is understood to be of a conventional double acting type. By such a construction, the piston 50 is moved by suitable application of hydraulic pressure, and this movement is in turn transmitted to the power transfer unit 36 which thereby moves between the retracted or non-cutting position of FIG. 4, and the extended or cutting position of FIG. 5. The bosses 40 are preferably secured to a mounting plate 54 which in turn is attached by suitable means to the mining machine.

Figure 8:
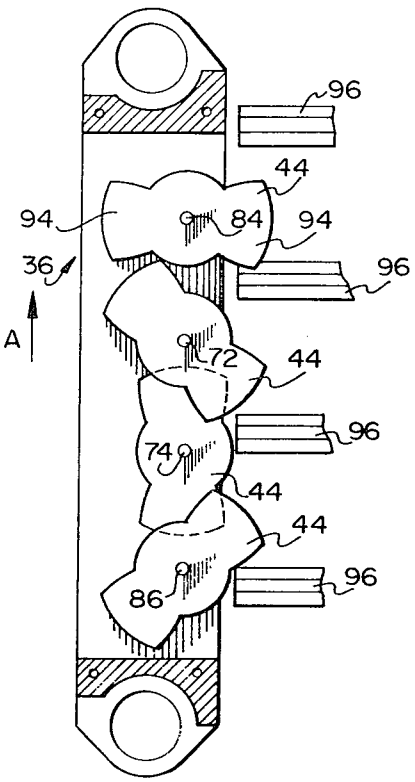
FIG. 8 is a longitudinal view of the propulsion motor showing the driving sprockets thereof.
Figure 7:
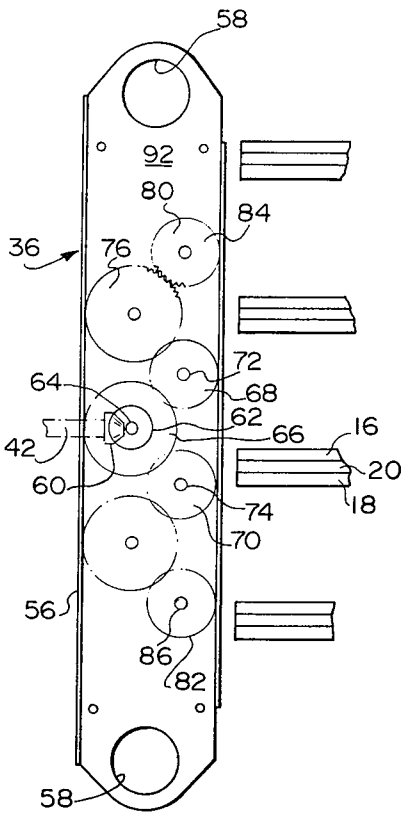
FIG. 7 is a longitudinal sectional view of the propulsion motor showing the gear train therein.

Referring now to FIGS. 7 and 8, the power transfer unit 36 will now be described. This unit is seen to comprise a housing 56 in which are formed the bosses 58 for receiving the pivot members 46. The power take-off connection 42 preferably is a shaft having a pinion gear 60 thereon. Pinion gear 60 in turn meshes with and drives a cooperating bevel 62 which is mounted on a common axle 64 with a drive gear 66. Gear 66 drives gears 68 and 70 which are mounted respectively on shafts 72 and 74. Gears 68 and 70 also mesh respectively with gears 76 and 78 which in turn drive gear 80 and 82 which are mounted on shafts 84 and 86 respectively.

Shafts 72, 74, 84, and 86 are journaled in the top and bottom plates 88 and 90 of the power transfer unit 36 for rotation therein. Since the gears 68, 70, 80, and 82 are fixed to the respective shafts 72, 74, 84, and 86, the gears and shafts rotate in unison. The shafts also pass through an intermediate plate 92 in the power transfer unit 36 and on the other side of the plate 92, drive members 44 are secured to the shafts 72, 74, 84 and 86. These members 44 are best illustrated in FIG. 8, and each is seen to include two teeth or lobes 94. The lobes 94 are such that they are capable of engaging the gusset plates 96 which correspond to the gusset plates 16 and 18 of FIG. 1, and since the plates 94 are stationary, rotation of the drive gears 44 results in longitudinal movement of the power transfer unit 36 and the mining machine 34. The direction of movement of the mining machine 34 is controlled by the direction of rotation of the drive gears 44. Thus, in FIG. 8, if the drive gears 44 are rotated in a clockwise direction, the power transfer unit 36 is moved laterally in the direction of arrow A, as seen in FIG. 8.

It is also preferable to arrange the drive gears 44 so that the major axis of each of the gears is rotated approximately 45° with respect to the major axis of any adjacent gear. Since the gears 44 are all rotated in unison, this angular spacing remains substantially constant. By virtue of this staggered arrangement, the movement of the power transfer unit and thus the mining machine is more constant.

Figure 9:
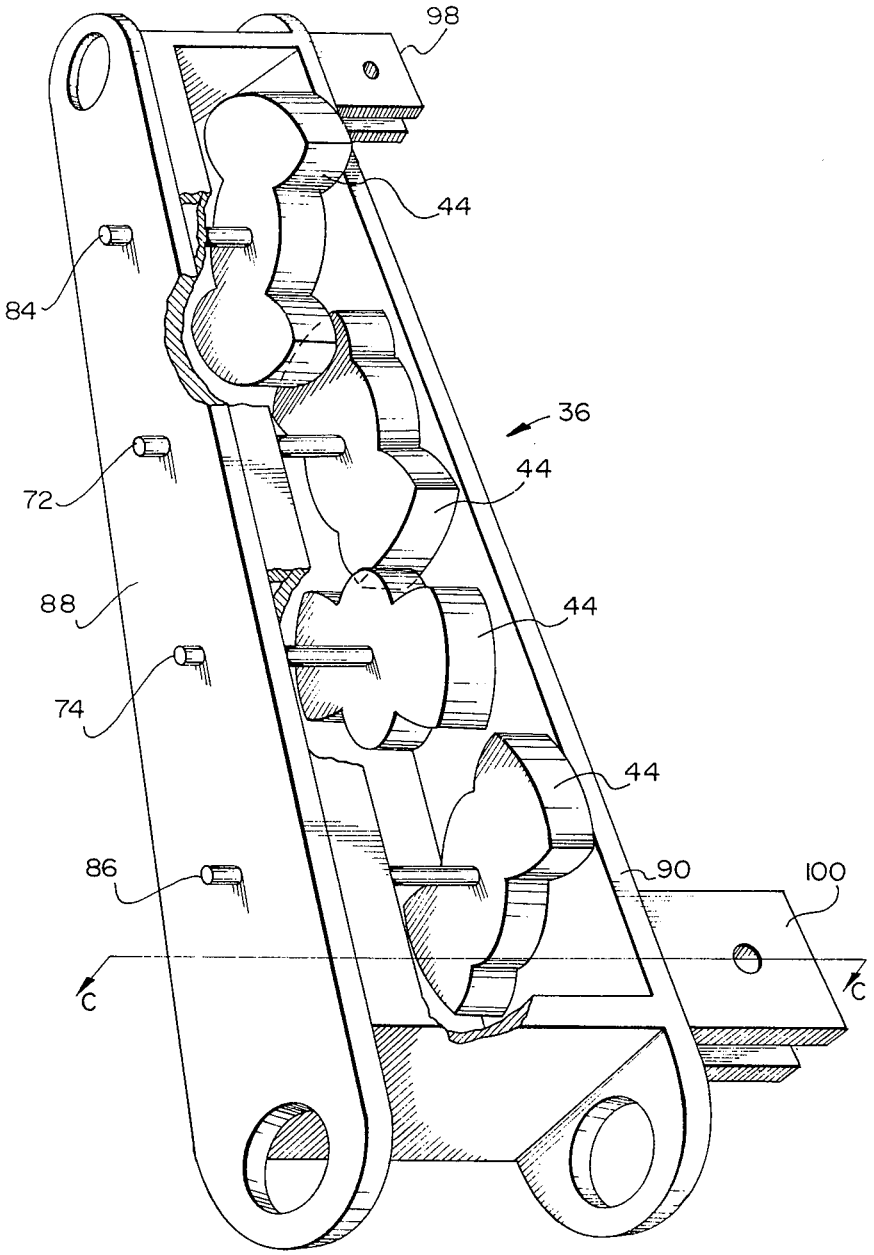
FIG. 9 is a perspective view of the propulsion motor with portions thereof broken away for clarity.

Of course it will be readily appreciated that although only four drive gears 44 are shown, by minor modifications to the apparatus, more or less drive gears may be provided. As seen in FIG. 9, the gears 44 are somewhat overlapped, and this of course is due to the spacing of the gusset plates. This spacing too is coordinated with the spacing between the shafts of the gears.

Figure 10:
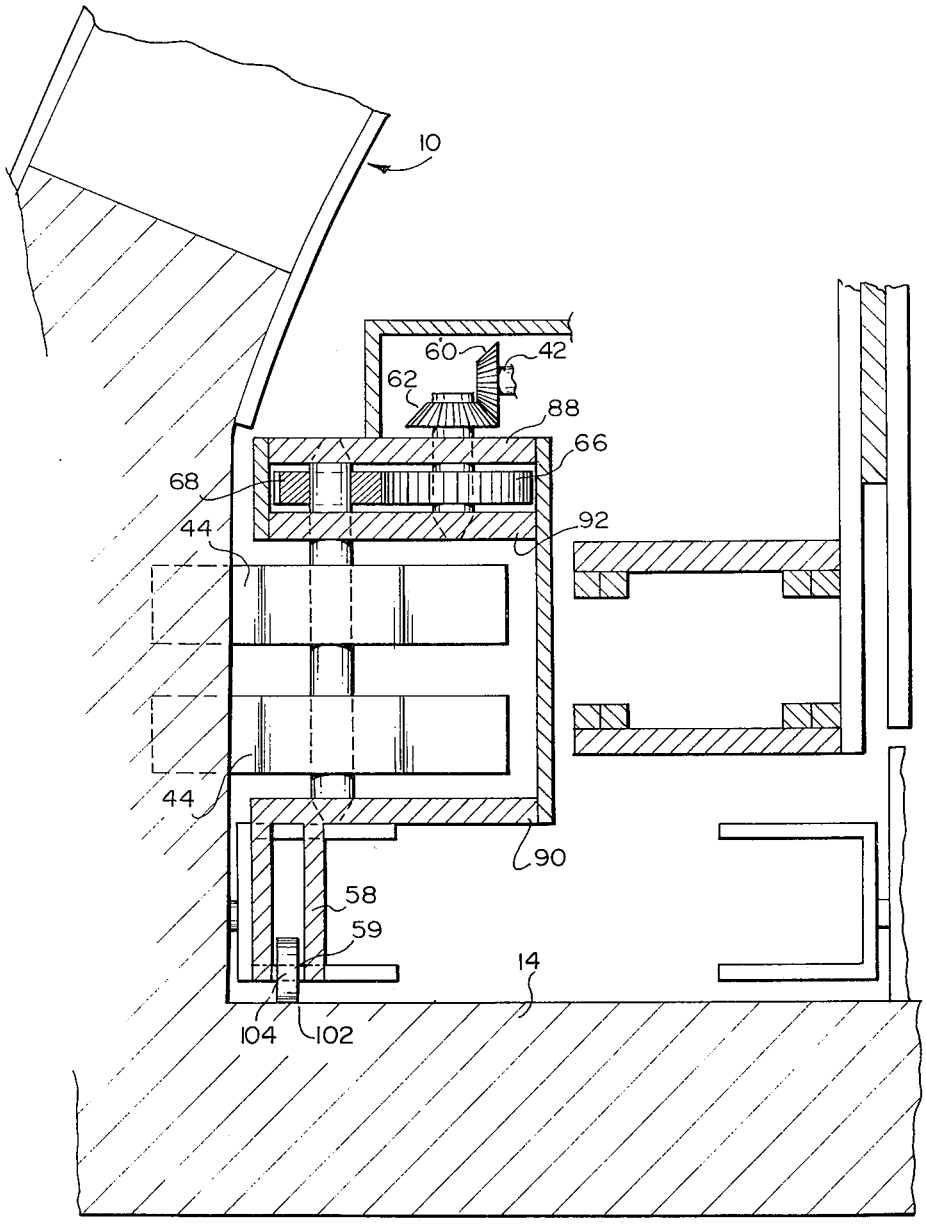
FIG. 10 is a vertical sectional view through the propulsion motor showing the relationship of various component elements.

On the bottom of the power transfer unit 36, are provided extensions 98 and 100 as seen in FIGS. 9 and 10, which extensions serve to mount idler wheels 102 on axles 104. These idler wheels serve to support the power transfer unit.

In operation, the power transfer unit 36 is shifted to the cutting position seen in FIG. 5 by applying fluid pressure from a suitable source (not shown) to the appropriate side of the pistons 50. Through the linkage connections as shown, the power transfer unit 36 is thereby shifted laterally toward the gusset plates 16 and 18.

The propulsion motor will always be engaged with the rack of the arches. There are two positions of the mining machinery, (1) cutting and (2) non-cutting. The non-cutting position is only assumed when transporting the machine along the Shield, when making a turn-about, or in emergency. In these cases the whole mining machine will be enclosed in the shield and the cutting drums will be in intermediate position and not in contact with the working face at the discretion of the operator, the propulsion motor can be moved away from the rack (to the non-cutting position) when maintenance or repairs are in progress. Machine is automatically stopped.

Drive power is supplied from the mining machine 34 to the power take-off connection 42. The exact nature of the power take-off unit forms no part of this invention. When the power take-off shaft 52 is rotated, the gear train is likewise operated and the drive gears 44 rotate so as to engage the arches 10. Since the power transfer unit 36 is fixed to the mining machine 34, the gusset plates 16 and 18 cooperate with the drive gears 44 in a manner similar to a racket-and-pinion arrangement and the mining machine is thereby propelled back and forth along its path relative to the arches 10.

When necessary, fluid pressure is released on the piston 50 and the power transfer unit 36 is thereby capable of being retracted to a non-cutting position, FIG. 4. It may still be engaged with the rack if the mining machine is retracted into the arch (intermediate position).

Figure 11:
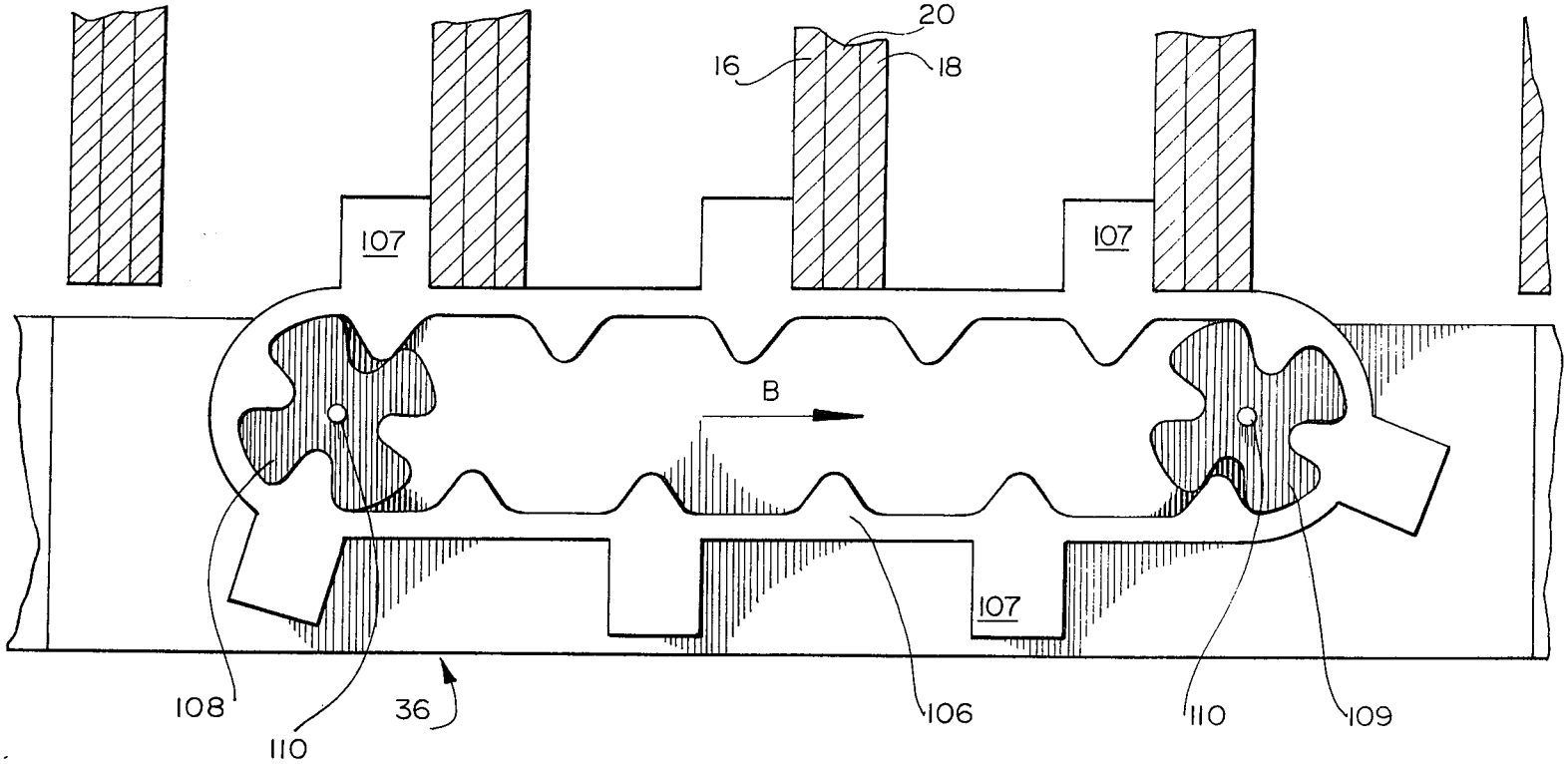
FIG. 11 is a longitudinal view of an alternate propulsion motor, in the form of an endless belt.

An alternative form of propulsion motor is depicted schematically in FIG. 11. In this embodiment, the propulsion device, shown in the cutting position, is mounted within power transfer unit 36 for rotation about a pair of drive sprockets 108,109. In this embodiment, like the embodiments of FIGS. 3–10, the device may be operated in either direction as the mining cutters are traversed back and forth across the mining face. When driven in the direction of arrow B, drive is transmitted to band 106 through drive sprocket 109, by shaft 110, sprocket 108 being permitted to idle. Band 106, as depicted, is of composite structure comprising a resilient material reinforced with steel in a manner known as per se. Around its outer periphery, the band is formed into projecting lugs 107, equidistantly spaced so that in the cutting position, contact is maintained with gusset plates 16, or 18, if in the reverse cutting direction. Lugs 107 are also reinforced with steel sections which are coupled into the main reinforcement of band 106.

While this invention has been described, it will be understood that it is capable of further modification, and this application is intended to cover any variations, uses and/or adaptations of the invention and including such departures from the present disclosures as come within known or customary practice in the art to which the invention pertains, and as may be applied to the essential features hereinbefore set forth, as fall within the scope of the invention or the limits of the appended claims.

What is claimed is:

1. A longwall propulsion means for the mining machine in a fixed arch shield mining apparatus wherein the mining machine is movably supported by the shield, the shield including a plurality of individually advanceable arch sections having a horizontal base portion and an upstanding portion in side-by-side relationship so that said upstanding portions collectively form a rack, said propulsion means comprising:

a. power transfer means secured to the mining machine, b. said power transfer means being shiftable from a non-driving position to a driving position, c. said power transfer means including a drive member engageable with said rack when said power transfer means is in said driving position, d. means for actuating said drive member so that said drive member engages said rack and thereby advances the mining machine relative to said shield.

2. A propulsion means as in claim 1 and including: means for shifting said power transfer means from said non-driving position to said driving position.

3. A propulsion means as in claim 2 and wherein: said shifting means comprises fluid motor means.

4. A propulsion means as in claim 2 and wherein: said shifting means comprises hydraulic piston and cylinder means connected to said power transfer means through connection linkage means.

5. A propulsion means as in claim 4 and wherein:

a. said drive member comprises a flexible endless band;

b. said band being mounted for rotation about drive means;

c. said band including, as part of the outer circumference thereof, arch engaging projections equidistantly spaced around said band, d. whereby said projections are engageable with the arches when the power transfer means are in said driving position.

6. A propulsion means as in claim 2 and wherein:

a. said power transfer means comprises a gearbox member, b. a pair of links pivotally connecting opposite ends of said gearbox member to fluid motor means secured to the mining machine, c. whereby upon actuation of said fluid motor means, said power transfer means is shifted between said cutting and non-cutting positions to facilitate maintenance or repairs.

7. A propulsion means as in claim 6 and wherein: said fluid motor means comprises hydraulic piston and cylinder means.

8. A propulsion means as in claim 7 and wherein:

a. said gearbox members includes a power input shaft, and b. a gear transmission for transmitting power from said input shaft to said drive member.

9. A propulsion means as in claim 8 and wherein:

a. said drive member comprises a pair of gears, b. each of said gears having two oppositely disposed teeth thereon, said teeth being engageable with the arches when said power transfer means is in said driving position.

10. A propulsion means as in claim 8 and wherein:

a. said drive member comprises multiple gears, b. each of said gears having two oppositely disposed teeth thereon, c. each of said gears being driven by said gear transmission, d. each of said gears being rotated such that at least two gears are in contact with the arches at all times.

11. A propulsion means as in claim 1 and wherein:

a. said power transfer means comprises a gear train for driving said drive member, and b. power supply means for operating said gear train and said drive member.

12. A propulsion means as in claim 11 and wherein:

said power supply means comprises a power take-off operatively associated with the mining machine.

* * * * *